US009500435B2

(12) United States Patent
Tseng

(10) Patent No.: US 9,500,435 B2
(45) Date of Patent: Nov. 22, 2016

(54) SPHERICAL PARTICLE DISPENSER

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 52 days.

(21) Appl. No.: 14/691,589

(22) Filed: Apr. 21, 2015

(65) Prior Publication Data

US 2015/0226515 A1 Aug. 13, 2015

(51) Int. Cl.
*F41B 11/53* (2013.01)

(52) U.S. Cl.
CPC ..... *F41B 11/53* (2013.01)

(58) Field of Classification Search
CPC ..... B65D 83/00; B65D 83/04; A61J 7/007; A47L 15/44; A61M 15/00
See application file for complete search history.

(56) References Cited

U.S. PATENT DOCUMENTS 2,870,739 A * 1/1959 Rodli ..... B44B 1/00 118/308
3,885,703 A * 5/1975 Neavin ..... B65D 83/0409 221/202
3,907,100 A * 9/1975 Ranford ..... B65B 35/00 198/350
3,918,607 A * 11/1975 Rowlette ..... B65G 59/067 221/15
4,150,766 A * 4/1979 Westendorf ..... B65D 83/0409 221/112
5,829,085 A * 11/1998 Jerg ..... A47L 15/4409 8/158
6,581,535 B2 * 6/2003 Barry ..... A01C 7/127 111/181
2007/0108223 A1 * 5/2007 Behrens ..... G07F 11/44 221/263
2007/0125794 A1 * 6/2007 Jones ..... G07F 11/14 221/231
2008/0308102 A1 * 12/2008 Davies ..... A61M 15/0045 128/203.15
2010/0012676 A1 * 1/2010 Freedman ..... A47F 1/08 221/24
2011/0108567 A1 * 5/2011 Giraud ..... B65D 83/0409 221/261
2011/0210139 A1 * 9/2011 Limback ..... A47L 15/4436 221/282
2011/0295416 A1 * 12/2011 Aquilonius ..... A61J 7/0076 700/232
2013/0035785 A1 * 2/2013 MacVittie ..... B65D 83/0409 700/231
2013/0256330 A1 * 10/2013 Wang ..... B65D 83/0409 221/1

* cited by examiner

*Primary Examiner* — Gene Crawford
*Assistant Examiner* — Ayodeji Ojofeitimi

(57) ABSTRACT

A powered dispenser includes a case including a central hole and a hopper in a channel for receiving spherical particles; a support disc including two opposite arc openings, an arc flange, a projection on the arc flange, and a first bossed hole; a rotatable disk including a second bossed hole put on the first bossed hole, two opposite pegs disposed through the openings, a curved slot between an edge of the rotatable disk and the second bossed hole with the projection moveably disposed therein, and striking members; a biasing member in a space defined between the flange and the edge of the rotatable disk; a cap including a hollow peg member in the first bossed hole; a spring biased retaining ring urging against the hole, and the retaining ring including two opposite sloped cuts with the pegs slidably disposed therein; a rotatable shaft; and a trigger switch.

2 Claims, 10 Drawing Sheets

SPHERICAL PARTICLE DISPENSER

BACKGROUND OF THE INVENTION

1. Field of the Invention

The invention relates to dispensers and more particularly to a spherical particle (e.g., airsoft pellet) dispenser.

2. Description of Related Art

Target practice using air and spring operated pellet guns has become popular in recent years. A conventional pellet dispenser for use with a pellet gun includes a housing, a rotatable cylinder in the housing for defining a plurality of pellet chambers, a hopper for defining an inclined bottom having apertures therein, a trigger slidably disposed on the housing in alignment with the chamber, the trigger defining an aperture for releasing a pellet through alignment with a plate aperture proximate the trigger, the trigger plate defining an aperture, the trigger reciprocal with the trigger plate for restraining a pellet by obstructing alignment of the trigger plate aperture, a resilient member contacting the trigger for restraining a pellet from exiting the trigger plate aperture as the trigger is actuated, thereby actuating the trigger to allow a pellet to exit from the dispenser for loading a pellet gun.

While the dispenser enjoys its success in the market, continuing improvements in the exploitation of dispenser of this type are constantly sought.

SUMMARY OF THE INVENTION

It is therefore one object of the invention to provide a dispensing device comprising a motor; a reduction gear box operatively connected to and activated by the motor; a case including a central hole, a channel depending downward from a periphery of the case, and a hopper disposed in the channel and configured to receive a plurality of spherical particles arranged in a column; a support disc including two opposite arc openings on a central portion, an arc flange proximate to an edge of the support disc, a projection formed on the arc flange, and a first bossed hole disposed between the arc openings; a rotatable disk including a second bossed hole depending downward from a center to put on the first bossed hole, two opposite pegs formed on a bottom of the second bossed hole and disposed through the arc openings, a curved slot formed between an edge of the rotatable disk and the second bossed hole with the projection moveably disposed therein, and a plurality of striking members extending outward from the edge of the rotatable disk; a biasing member anchored in a space defined between the arc flange and the edge of the rotatable disk; a cap including a hollow peg member depending downward from a center into the first bossed hole; a spring biased retaining ring disposed above the reduction gear box, the retaining ring being urged against an edge of the central hole, and the retaining ring including two opposite sloped cuts on an edge with the pegs slidably disposed therein; a rotatable shaft operatively connected to and driven by the reduction gear box, the rotatable shaft passing through the retaining ring into the first bossed hole; a fastener driven through the peg member and the second bossed hole into the rotatable shaft; a trigger switch electrically connected to the motor; and a motor reverse rotation button electrically connected to the motor; wherein the projection is disposed at a first end of the slot and the pegs are at first ends of the arc openings in an ready position; wherein in a dispensing operation, in response to an activation of the motor, the rotatable shaft rotates in a first direction via the reduction gear box, the support disc rotates in the first direction, the projection moves along the slot toward a second end of the slot with the biasing member being compressed due to reduction of the space, the rotatable disk rotates in the first direction after the projection moving to and stopped at the second end of the slot, the pegs move along the arc openings toward second ends of the arc openings and downward on the sloped cuts, the retaining ring is pressed by the pegs to press the trigger switch, the trigger switch is triggered to deactivate the motor, the support disc stops rotating, the biasing member expands to rotate the rotatable disk in a second direction opposing the first direction, one of the striking members strikes one of the spherical particles for dispensing, at the end of the dispensing, the pegs move upward on the sloped cuts to return to the ready position, the retaining ring bounces to the ready position, the support disc returns to the ready position, and another one of the spherical particles is pushed from the hopper to the ready position, and the motor is activated again; and wherein a pressing of the motor reverse rotation button activates the motor in response to failure of the dispensing operation.

The above and other objects, features and advantages of the invention will become apparent from the following detailed description taken with the accompanying drawings.

DETAILED DESCRIPTION OF THE INVENTION

Figure 1:
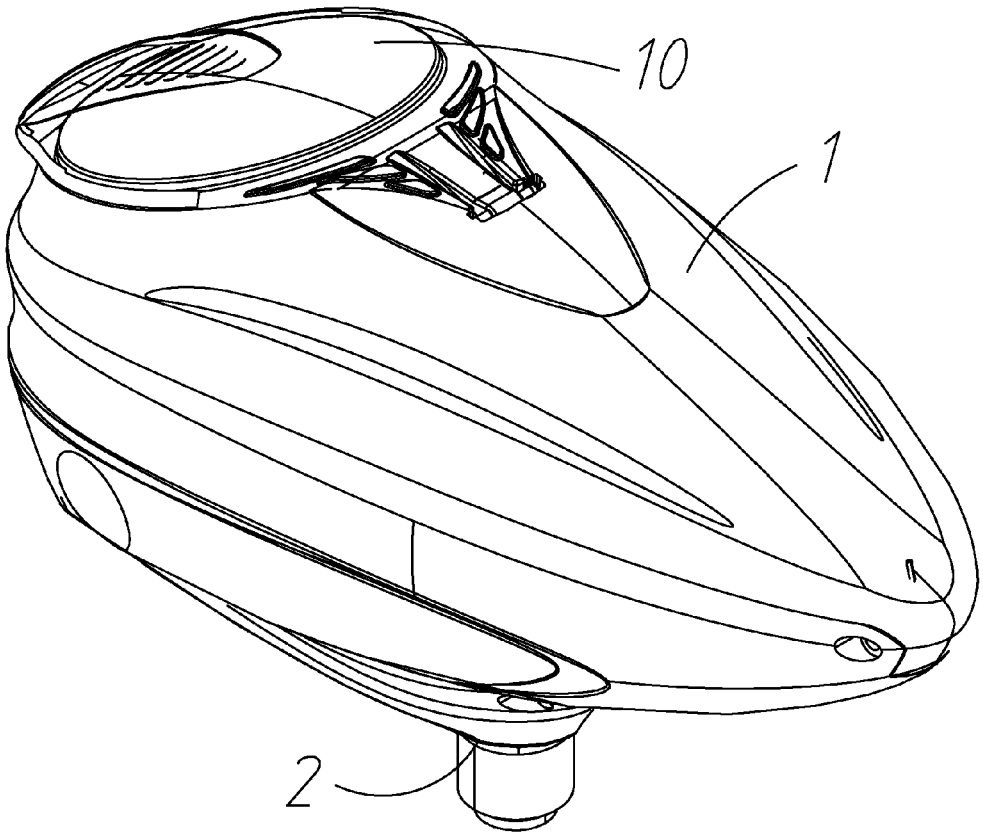
FIG. 1 is a perspective view of a spherical particle dispenser according to the invention.
Figure 2:
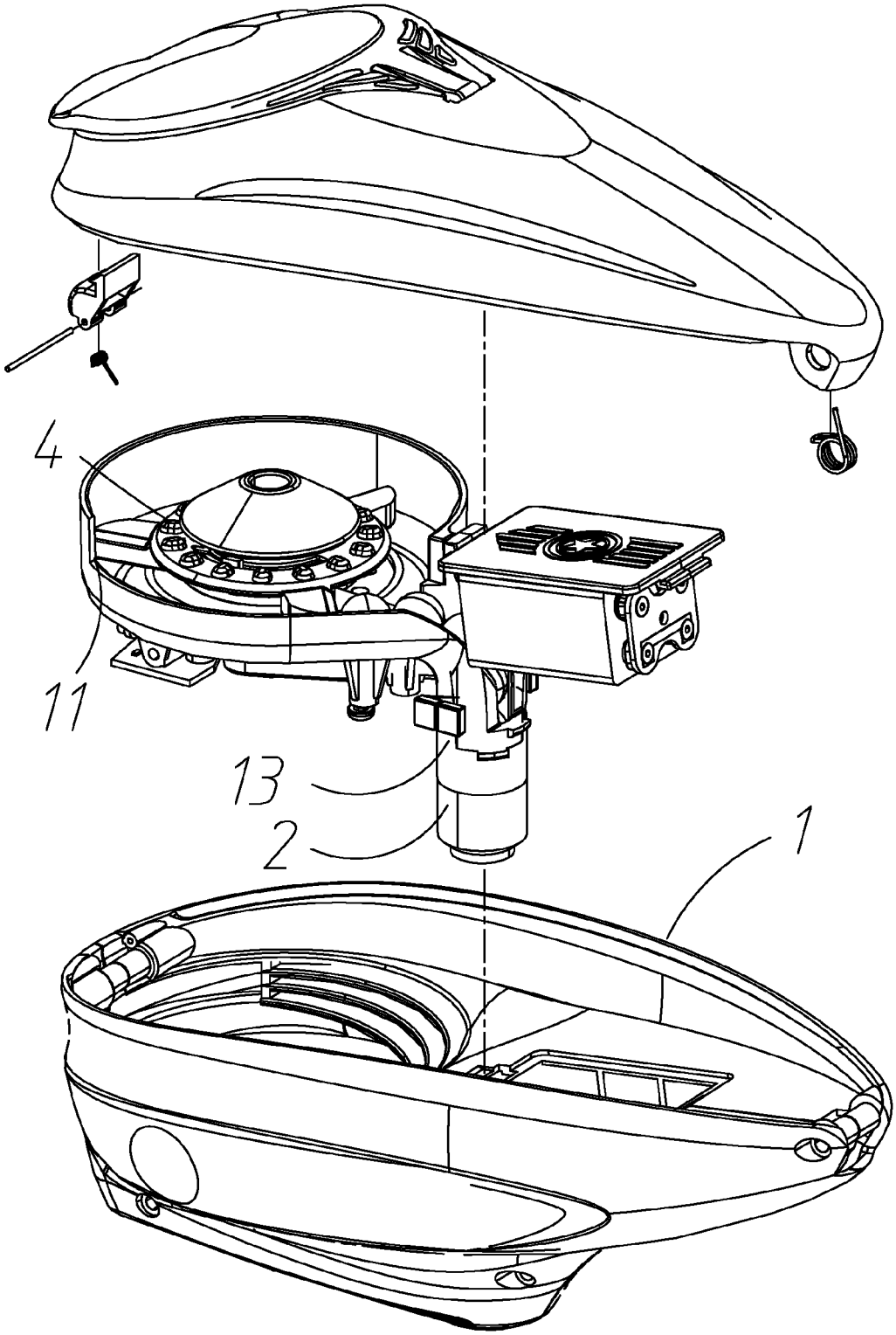
FIG. 2 is an exploded, perspective view of the spherical particle dispenser.
Figure 3:
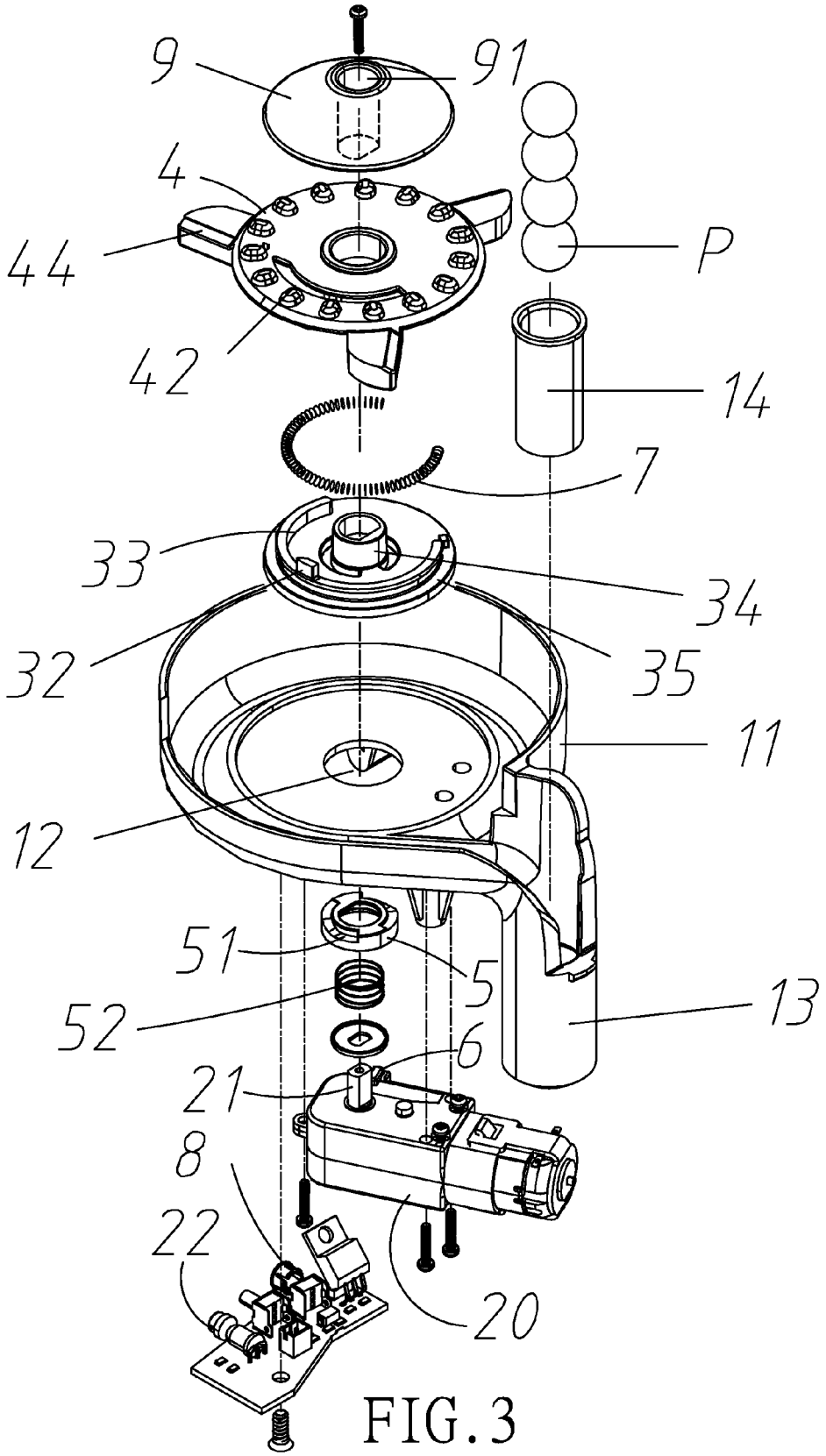
FIG. 3 is an exploded view of the components in a central portion of FIG. 2.
Figure 3A:
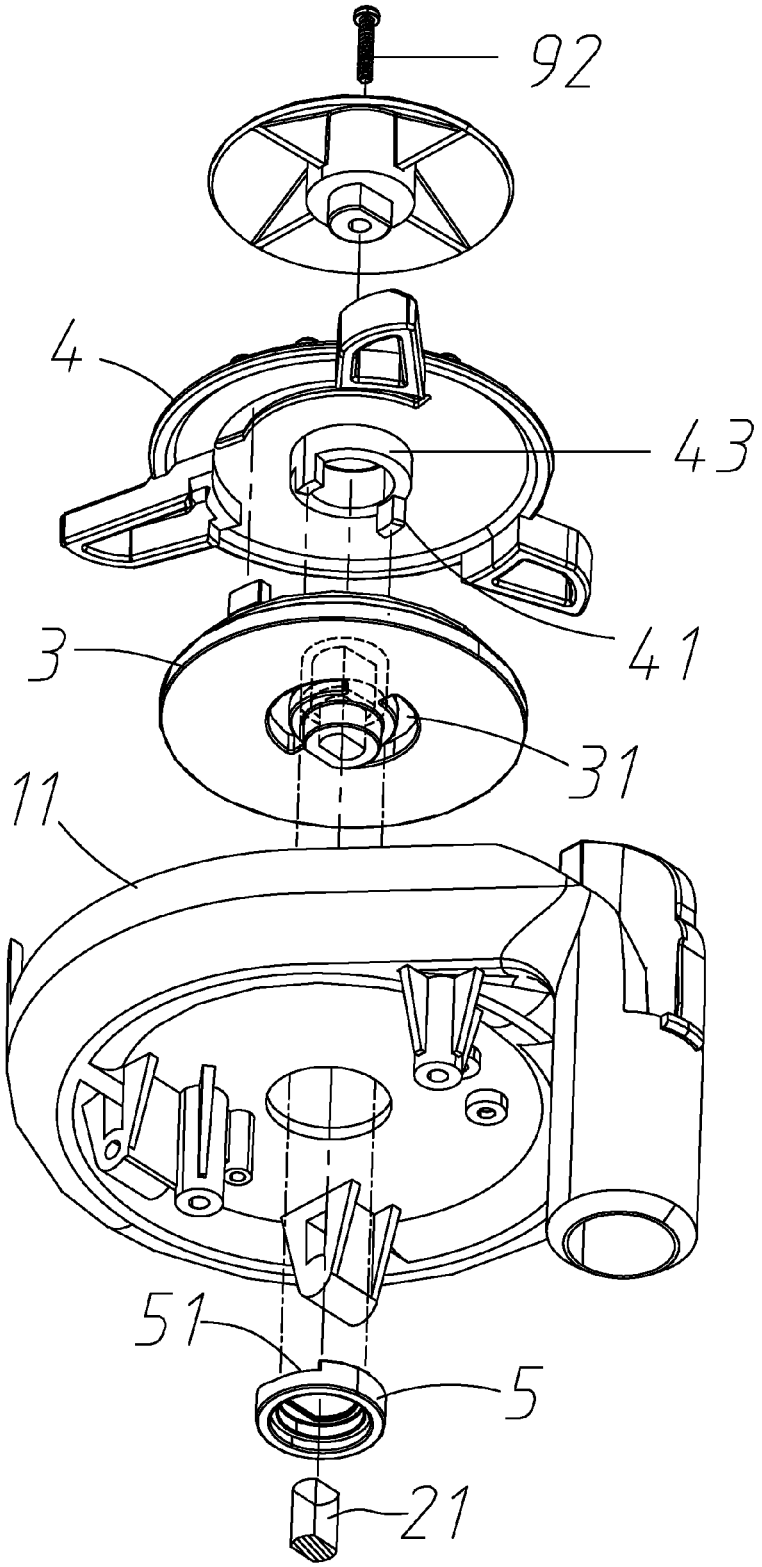
FIG. 3A is another exploded view of the components in central and upper portions of FIG. 3.
Figure 4:
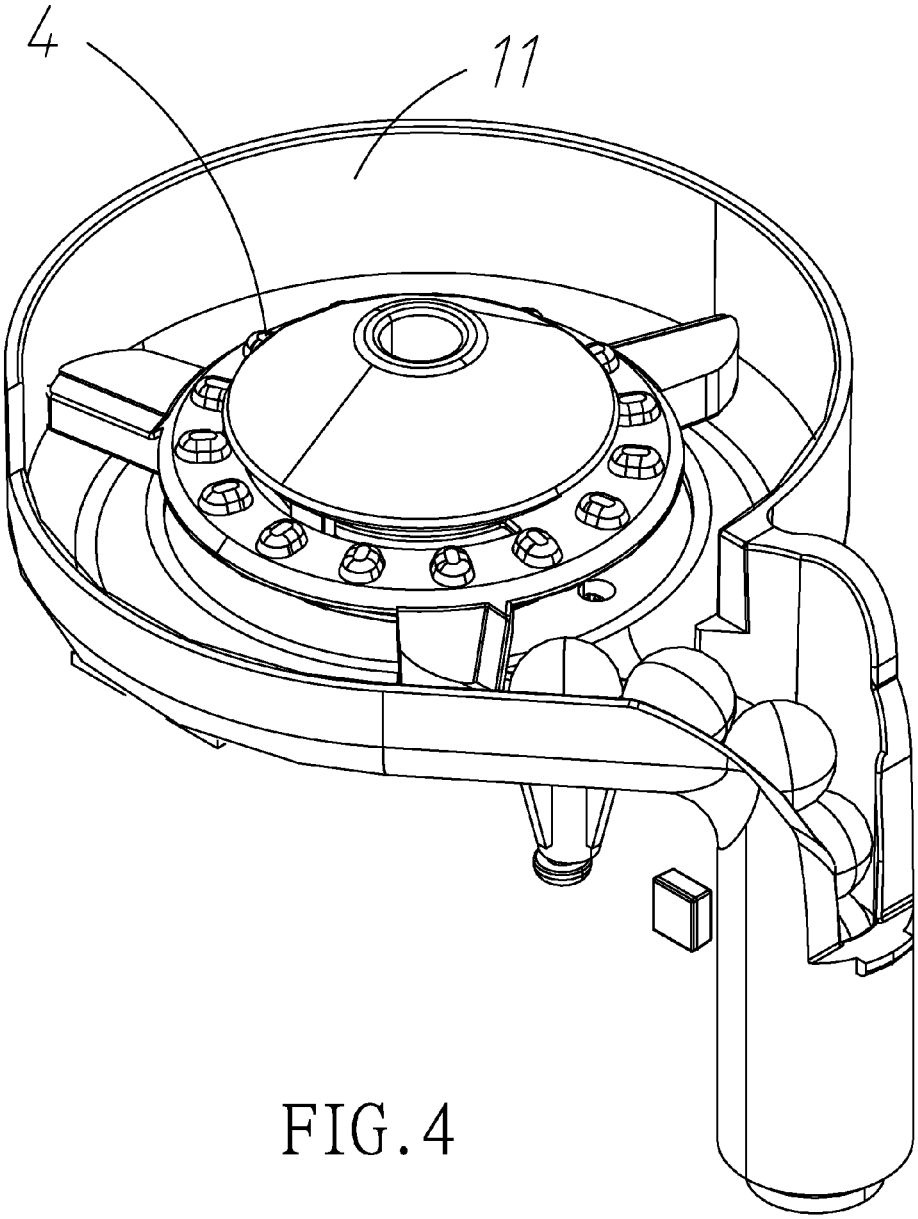
FIG. 4 is an enlarged view of the case in FIG. 2.
Figure 5:
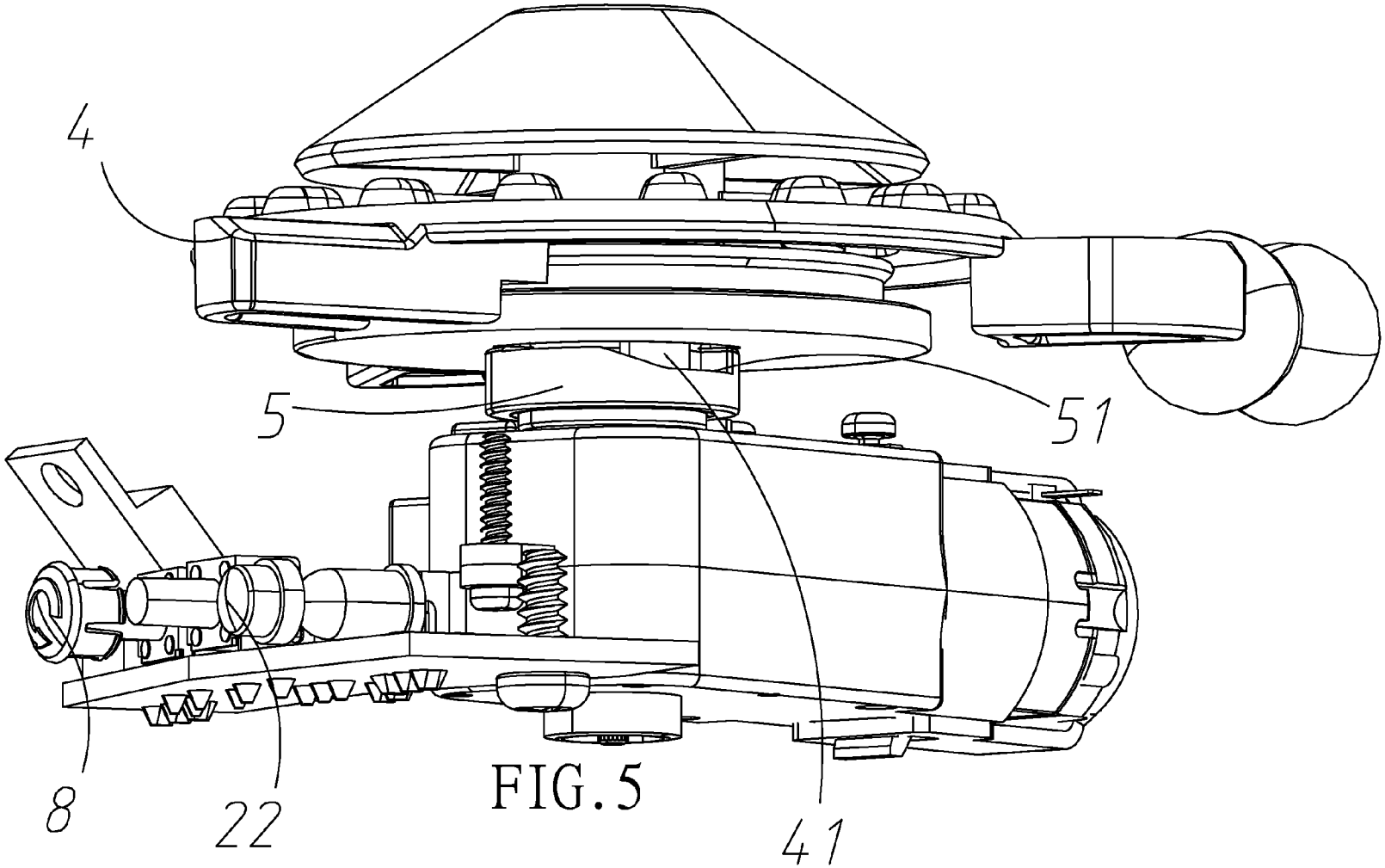
FIG. 5 is a perspective view of the assembled components of FIG. 3.
Figure 6:
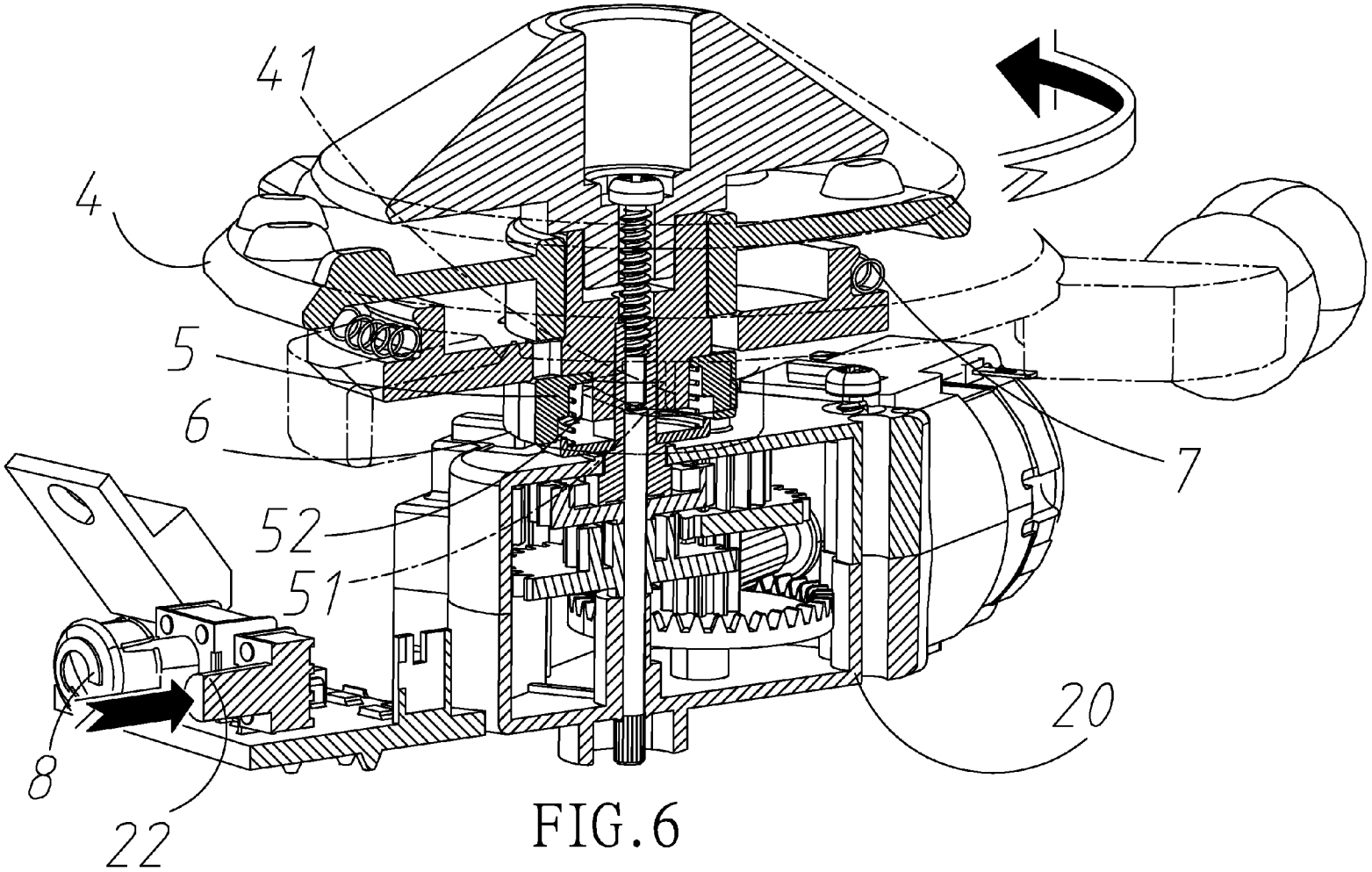
FIG. 6 is a longitudinal sectional view of FIG. 5 showing the activated dispenser.
Figure 7:
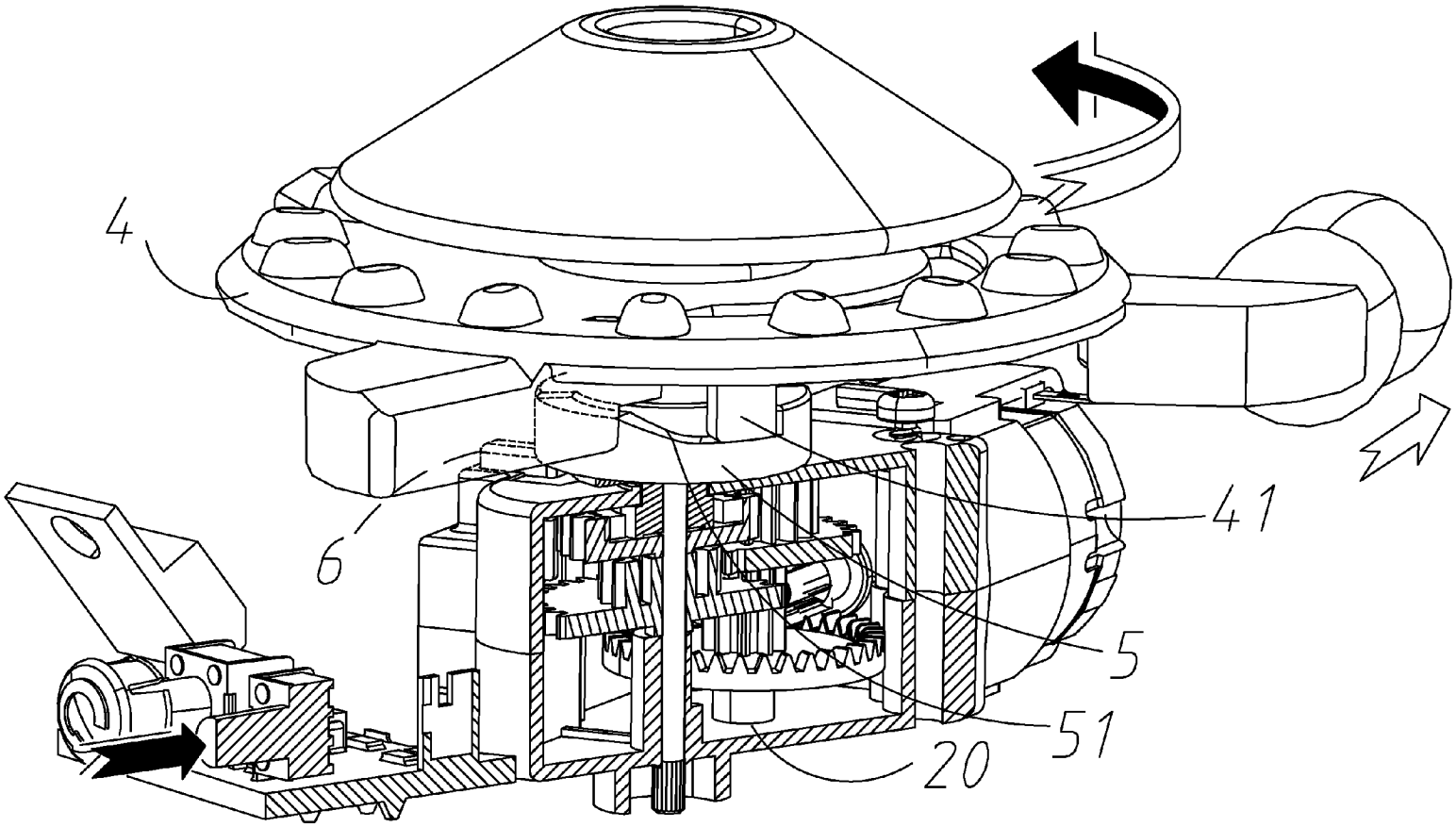
FIG. 7 is a perspective view in part section of FIG. 5 showing the activated dispenser.
Figure 8:
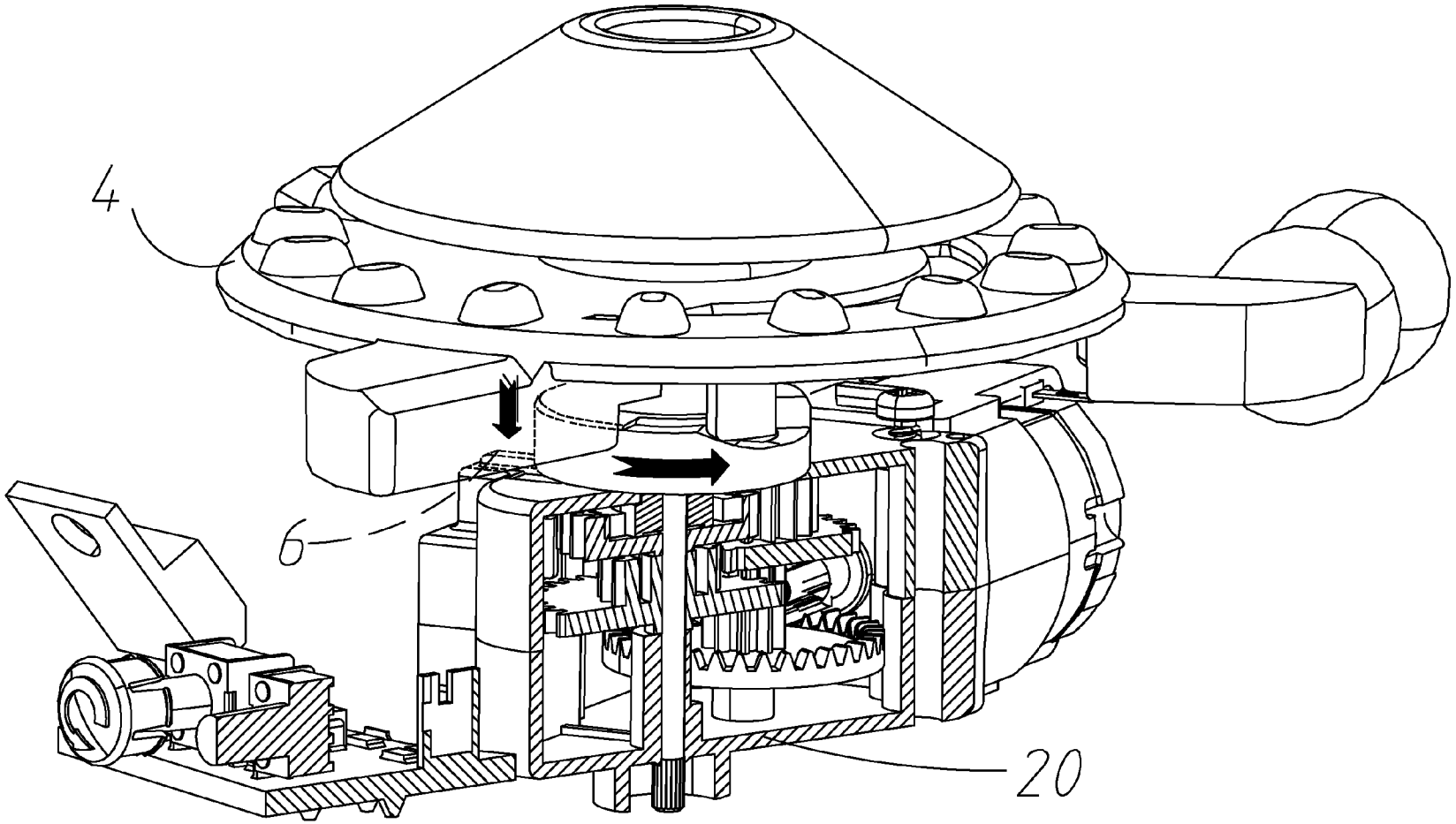
FIG. 8 is a view similar to FIG. 7 showing the deactivated dispenser.
Figure 9:
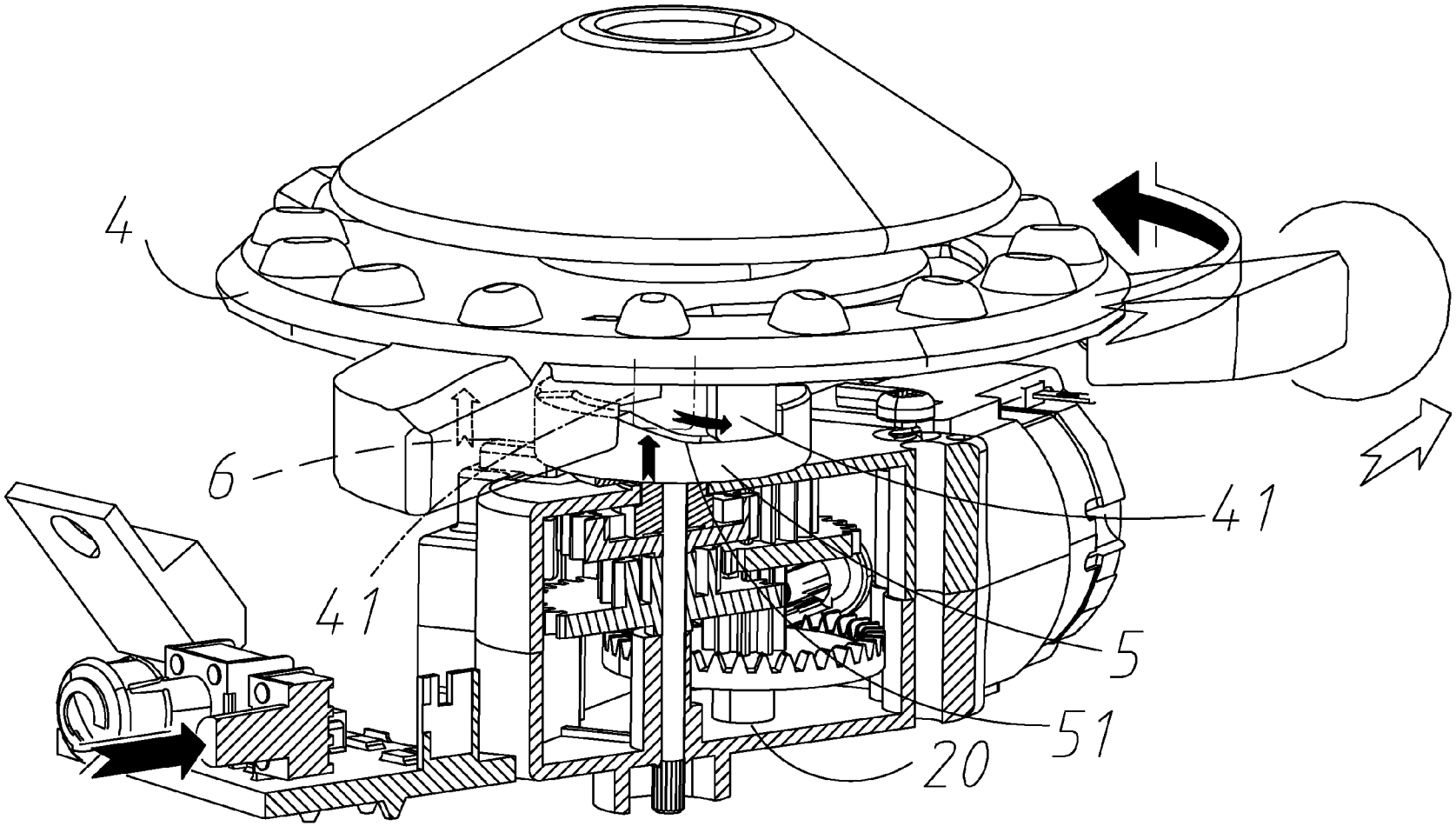
FIG. 9 is a view similar to FIG. 8 where the dispenser activates again.

Referring to FIGS. 1 to 9, a spherical particle (e.g., airsoft pellet P) dispenser in accordance with the invention comprises the following components as discussed in detail below.

A housing 1 includes a top cover 10. A motor 2 is provided on an underside of the housing 1 and includes a reduction gear box 20 having a shaft 21 extending outward. A case 11 includes a central hole 12, a channel 13 depending downward from a periphery of the case 11, and a cylindrical hopper 14 in the channel 13. A plurality of spherical particles P are stacked in the hopper 14 in a column configuration for ease of loading. A support disc 3 includes two opposite arc openings 31 on a central portion of a bottom, an arc flange 33 proximate to an edge of the support disc 3, a projection 32 formed on a top of an intermediate portion of the flange 33, and a bossed hole 34 on a center between the arc openings 31.

A rotatable disk 4 includes a bossed hole 43 depending downward from a center to put on the bossed hole 34, two opposite pegs 41 formed on bottom of the bossed hole 43 and disposed through the arc openings 31, a curved slot 42 formed between an edge and the bossed hole 43 with the projection 32 moveably disposed therein, and three equally spaced striking members 44 extending outward from an edge of the rotatable disk 4. An arc spring 7 is anchored in a space 35 defined by the flange 33, a downward extending edge of the rotatable disk 4, and a portion of the support disc 3 between the flange 33 and the edge of the rotatable disk 4. A cap 9 includes a hollow peg 91 depending downward from a center into the bossed hole 34. A retaining ring 5 includes two opposite sloped cuts 51 on an edge with the pegs 41 slidably disposed therein, and a torsion spring 52 put on the shaft 2 and biased between the reduction gear box 20 and a holed top of the retaining ring 5 to urge the retaining ring 5 against the edge of the central hole 12. A screw 92 is driven through the peg 91 and the bossed hole 43 into the shaft 21 which passes through the torsion spring 52 and the retaining ring 5 into the bossed hole 34. An on/off switch 22 is electrically connected to the motor 2. A trigger switch 6 is electrically connected to the motor 2. A motor reverse rotation button 8 is electrically connected to the motor 2.

The projection 32 is disposed at one end of the slot 42 and the pegs 41 are at one ends of the arc openings 31 in an inoperative position.

A dispensing operation of the invention is described below. The on/off switch 22 is turned on. Next, the motor 2 activate to clockwise rotate the shaft 21 via the reduction gear box 20. The support disc 3 rotates in the same direction as the shaft 21. The projection 32 moves along the slot 42 toward the other end of the slot 42 with the spring 7 being compressed due to reduction of the space 35. The rotatable disk 4 begins to rotate after the projection 32 moving to the other end of the slot 42 and being stopped (i.e., there is a time delay). The pegs 41 then move along the arc openings 31 toward the other ends of the arc openings 32 and move downward on the sloped cuts 51. Thus the retaining ring 5 is pressed downward by the pegs 41 to press the trigger switch 6 with the spring 52 compressed. The trigger switch 6 is thus triggered to deactivate the motor 2 (i.e., rotation stopped). The support disc 3 stops rotating. And in turn, the compressed spring 7 expands to counterclockwise rotate the rotatable disk 4. And in turn, the striking member 44 strikes the spherical particle P to discharge it for dispensing. At the end of the dispensing, the pegs 41 move upward on the sloped cuts 51 to return to its ready position. The retaining ring 5 also bounces to its ready position. And in turn, the support disc 3 returns to its ready position. A next spherical particle 7 is pushed upward from the hopper 14 to dispose in a ready to dispense position. The motor 2 is activated again because the trigger switch 6 is turned off. The above dispensing operation repeats automatically if the on/off switch 22 is still turned on. A user may press the motor reverse rotation button 8 to activate the motor 2 if the spherical particle dispensing is jammed. The activated motor 2 can return the dispenser to its normal operation.

While the invention has been described in terms of preferred embodiments, those skilled in the art will recognize that the invention can be practiced with modifications within the spirit and scope of the appended claims.

What is claimed is:

1. A dispensing device comprising:

a motor;

a reduction gear box operatively connected to and activated by the motor;

a case including a central hole;

a support disc including two opposite arc openings on a central portion, an arc flange proximate to an edge of the support disc, a projection formed on the arc flange, and a first bossed hole disposed between the arc openings;

a rotatable disk including a second bossed hole depending downward from a center to put on the first bossed hole, two opposite pegs formed on a bottom of the second bossed hole and disposed through the arc openings, a curved slot formed between an edge of the rotatable disk and the second bossed hole with the projection moveably disposed therein, and a plurality of striking members extending outward from the edge of the rotatable disk;

a biasing member anchored in a space defined between the arc flange and the edge of the rotatable disk;

a spring biased retaining ring disposed above the reduction gear box, the retaining ring being urged against an edge of the central hole, and the retaining ring including two opposite sloped cuts on an edge with the pegs slidably disposed therein;

a rotatable shaft operatively connected to and driven by the reduction gear box, the rotatable shaft passing through the retaining ring into the first bossed hole;

a fastener driven through the second bossed hole into the rotatable shaft; and a trigger switch electrically connected to the motor;

wherein the projection is disposed at a first end of the slot and the pegs are disposed at first ends of the arc openings in a ready position; and wherein in a dispensing operation, in response to an activation of the motor, the rotatable shaft rotates in a first direction via the reduction gear box, the support disc rotates in the first direction, the projection moves along the slot toward a second end of the slot with the biasing member being compressed due to reduction of the space, the rotatable disk rotates in the first direction after the projection moving to and stopped at the second end of the slot, the pegs move along the arc openings toward second ends of the arc openings and downward on the sloped cuts, the retaining ring is pressed by the pegs to press the trigger switch, the trigger switch is triggered to deactivate the motor, the support disc stops rotating, the biasing member expands to rotate the rotatable disk in a second direction opposing the first direction, one of the striking members strikes one of a plurality of spherical particles for dispensing, at the end of the dispensing the pegs move upward on the sloped cuts to return to the ready position, the retaining ring bounces to the ready position, the support disc returns to the ready position, and the motor is activated again.

2. The dispensing device of claim 1, further comprising a motor reverse rotation button electrically connected to the motor, wherein a pressing of the motor reverse rotation button activates the motor in response to failure of the dispensing operation.

* * * * *